United States Patent [19]

Maura

[11] 4,151,664

[45] May 1, 1979

[54] RIPPER ATTACHMENT FOR BACKHOE OR FRONT END LOADER

[76] Inventor: Nicholas Maura, R.D. 1 Birchwood Dr., Duanesburg, N.Y. 12056

[21] Appl. No.: 815,789

[22] Filed: Jul. 14, 1977

[51] Int. Cl.[2] ..... E02F 3/76

[52] U.S. Cl. ..... 37/117.5; 37/DIG. 3; 37/DIG. 12; 299/67; 414/725

[58] Field of Search ..... 37/DIG. 3, 117.5, 118 R, 37/118 A, 141 R, 141 T, DIG. 12; 299/67, 38; 214/145 R

[56] References Cited

U.S. PATENT DOCUMENTS

| | | | |
|---|---|---|---|
| 2,262,415 | 11/1941 | Williams et al. | 37/DIG. 3 |
| 2,783,558 | 3/1957 | Morgan | 37/117.5 X |
| 2,952,929 | 9/1960 | Lindberg | 37/117.5 UX |
| 2,969,966 | 1/1961 | Mathers | 37/117.5 X |
| 3,039,210 | 6/1962 | Slaughter | 37/117.5 |
| 3,595,416 | 7/1971 | Perrotti | 37/117.5 X |
| 3,675,349 | 7/1972 | Luck | 37/117.5 |
| 3,999,315 | 12/1976 | Nye | 37/DIG. 12 |
| 4,038,766 | 8/1977 | Felstet | 37/DIG. 3 |
| 4,041,624 | 8/1977 | Fryrear | 37/117.5 |

FOREIGN PATENT DOCUMENTS

| | | | |
|---|---|---|---|
| 2227399 | 11/1974 | France | 37/117.5 |

*Primary Examiner*—Clifford D. Crowder

[57] ABSTRACT

An attachment for a backhoe bucket or front end loader bucket comprising, in the case of the backhoe bucket, a pair of connected rippers attached to the inside of the bucket and, in the case of the front end loader bucket, at least three connected rippers attached inside the bucket. The rippers are attached by pins to the sides and upper bottom portion of the bucket. The earth engaging ends of the rippers are above the bucket edge so that the rippers will dislodge earth which subsequently falls into the bucket and the bucket edge can be used for finish work without ripper interference.

2 Claims, 4 Drawing Figures

RIPPER ATTACHMENT FOR BACKHOE OR FRONT END LOADER

BRIEF SUMMARY

Prior art excavators have had the ripper teeth behind the backhoe bucket where the operator could not see what they were doing. I have improved this by putting the teeth in the front of the bucket, so the operator can see them. It also improves fuel consumption. The operator does not have to break up the earth and then go back and pick it up, which is wasted motion. Having the teeth in front of the bucket improves operating efficiency by creating a one sweep operation of breaking up earth, (shale, stone or frost), and removing it at the same time.

On front end loaders the ripper teeth will be in front of the bucket, but not on the cutting edge. The teeth will aid in breaking up earth, yet will be out of the way for smooth finish grading.

DETAILED DESCRIPTION

Figure 1:
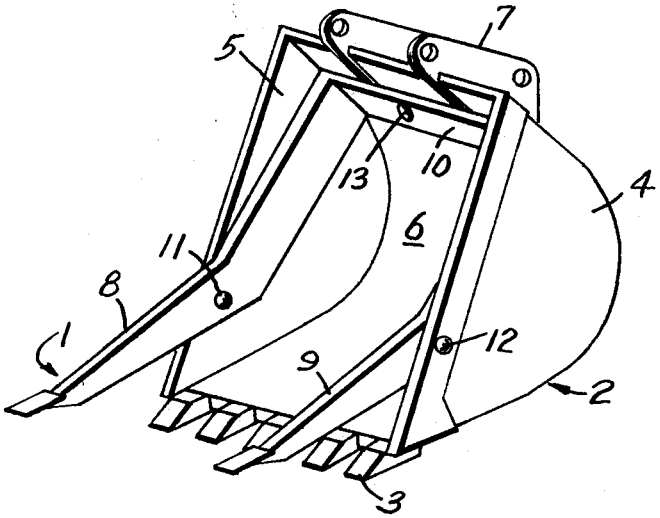
FIG. 1 is a view of a conventional backhoe bucket provided with the attachment of my invention.

FIG. 1 illustrates the improved ripper attachment 1 situated in a conventional backhoe bucket 2. The bucket 2 has teeth 3 at the lower leading edge thereof, sides 4,5 and a curved bottom 6. Lugs 7 are situated on the upper portion of bottom 6 to facilitate mounting of the bucket on an excavator. The ripper attachment 1 comprises a pair of ripper teeth 8,9 integrally connected by member 10. The rippers 8,9 are parallel to each other and fastened against the bucket sides 4,5 by means of conventional snap ring type pins 11,12 and the connecting member or cross piece 10 is fastened against the upper portion of the bottom 6 by similar pins such as 13. Connecting the rippers in the manner shown is advantageous since this way they break up earth and allow it to fall into the bucket. Having the rippers in this position puts less strain on the outer cutting teeth and on the edges of the bucket. As shown, the only part of the ripper attachment projecting out of the bucket is the working or earth engaging portions of the rippers.

Figure 2:
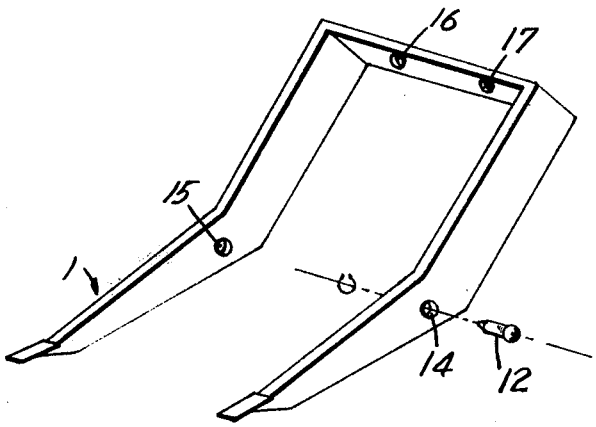
FIG. 2 is a view of the attachment shown in FIG. 1 and a split ring connector, absent the backhoe bucket.

FIG. 2 is a view of the ripper attachment of FIG. 1 without the backhoe bucket. The ripper teeth are one complete unit and slip inside of the bucket. The hole locations (14–17) on the ripper teeths' attachment to the bucket are located at the stress points. Attachment of the teeth to the bucket consists of cutting four holes in the bucket. The teeth are then attached to the bucket with four pins. The teeth are removable from the bucket by taking out the four pins. One of the pins (12) is illustrated in FIG. 2. The pins are snap ring type, the same as the pins that attach the backhoe buvcket to the machine. This makes the teeth easily removed for use of the bucket without the ripper teeth. When the improved ripper teeth are removed there are no brackets or flanges protruding from the bucket as with conventional models and the bucket will still hold water to the level of the holes.

Figure 3:
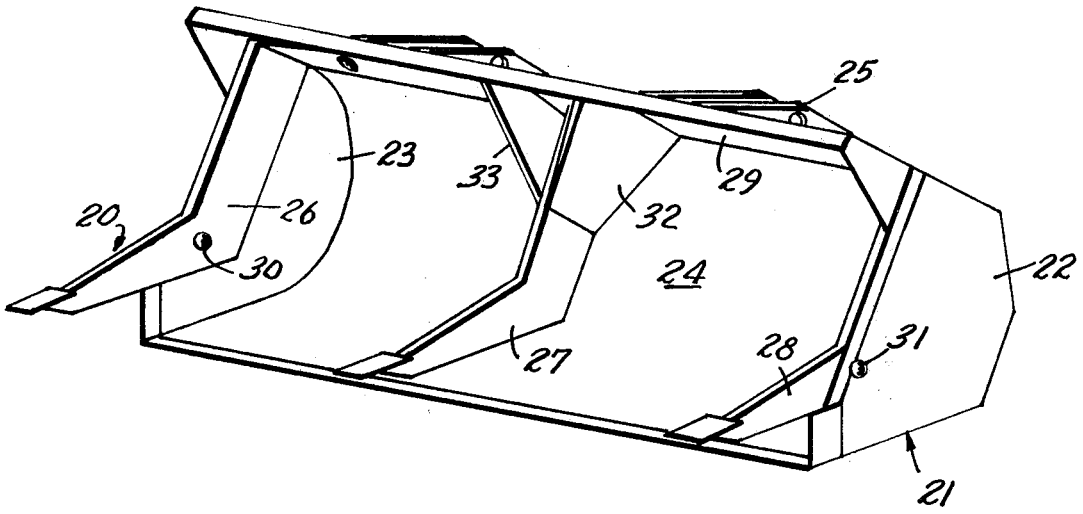
FIG. 3 is a view of a conventional front end loader bucket provided with the attachment of my invention.

FIG. 3 illustrates and improved ripper attachment 20 situated in a conventional front end loader bucket 21. The bucket has sides 22,23, a curved bottom 24 and attachment lugs such as 25. The ripper attachment comprises three ripper teeth 26,27,28 connected by member 29. The rippers 26,28 are fastened against the bucket sides 23,22 by means of pins 30,31 similar to pin 12 of FIG. 2. The member 29 is similarly connected to the upper portion of bottom 24. The center ripper 27 is suitably attached to the member 29 and appropriately braced as at 32,33. Having the teeth inside and in front of the bucket makes them break up earth and lets it fall into the bucket. The teeth in the loader bucket will aid in loading hard materials, such as shale, from a bank by breaking it up and letting it fall into the bucket. An advantage of having the teeth inside of the bucket, over models with teeth on the cutter edge, is that the bucket is not only more efficient, but the cutter edge is free for smooth finish grading.

Figure 4:
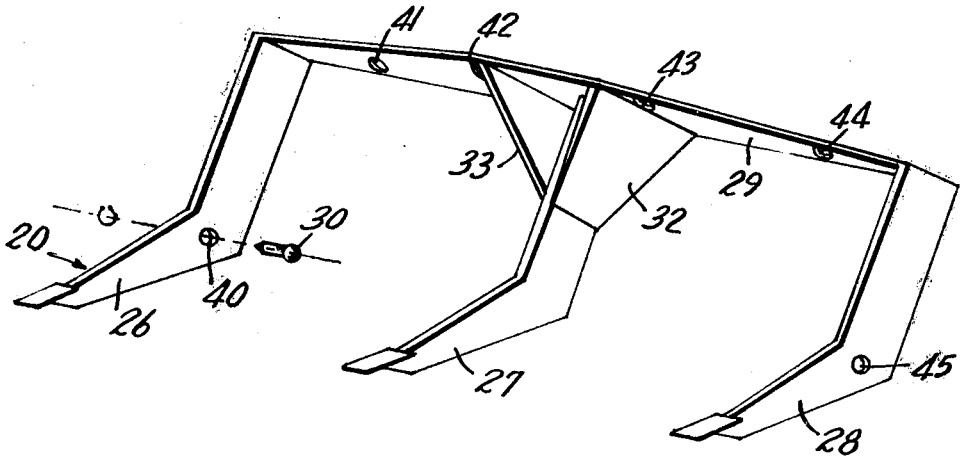
FIG. 4 is a view of the attachment shown in FIG. 3 and a split ring connector, absent the front end loader bucket.

FIG. 4 shows the front end loader ripper attachment 20 removed from the bucket. The ripper teeth are one complete unit and slip inside of the bucket. The hole locations (40–45) on the ripper teeths' attachment to the bucket are located at the stress points. They are attached to the bucket by cutting six holes. The teeth are attached with six snap ring pins, such as 30. The snap ring pins are the same ones as for the backhoe ripper teeth of FIGS. 1,2. This makes the teeth easily removable from the bucket in case the bucket has to be used without the teeth. The ripper teeth may also be used when carrying pipes or logs in the bucket by holding them from rolling off the edge.

I claim:

1. A backhoe bucket and ripper combination comprising:

a backhoe bucket comprising a curved bottom with a leading edge and a pair of sides connected to the curved bottom;

a ripper attachment comprising a pair of parallel ripper members integrally connected by a transverse connecting member;

said attachment being secured to the inside of said backhoe bucket with each ripper member being secured against a respective side of the bucket by means of a pin and the connecting member being secured against the upper portion of the curved bottom of the bucket by means of a plurality of pins;

the only portion of said attachment projecting outside the bucket being the earth engaging portions of the ripper members, said earth engaging portions being located above and in front of the leading edge of the curved bottom of the bucket, whereby said ripper members may be used to loosen material for delivery to the bucket.

2. A front end loader bucket and ripper combination comprising:

a front end loader bucket comprising a curved bottom with a leading edge and a pair of sides connected to the curved bottom;

a ripper attachment comprising at least three parallel ripper members connected by a transverse connecting member;

said attachment being secured to the inside of said front end loader bucket with a ripper member being secured against each side of the bucket by means of a pin and the connecting member being secured to the upper portion of the curved bottom of the bucket by means of a plurality of pins, at least one of the at least three ripper members being secured and braced to the connecting member between the ripper members attached to the bucket sides;

the only portion of said attachment projecting outside the bucket being the earth engaging portions of the ripper members, said earth engaging portions being located above and in front of the leading edge of the curved bottom of the bucket, whereby said rippers may be used to loosen material for delivery to the bucket and the leading edge of the curved bottom of the bucket may be used for grading without interference from the ripper members.

* * * * *